US005512981A

United States Patent [19]

Hirsch

[11] Patent Number: 5,512,981

[45] Date of Patent: Apr. 30, 1996

[54] HYBRID DEVELOPMENT TYPE ELECTROSTATOGRAPHIC REPRODUCTION MACHINE HAVING A WRONG-SIGN TONER PURGING MODE

[75] Inventor: Mark J. Hirsch, Fairport, N.Y.

[73] Assignee: Xerox Corporation, Stamford, Conn.

[21] Appl. No.: 473,179

[22] Filed: Jun. 7, 1995

[51] Int. Cl.[6] ..... G03G 21/14; G03G 15/06

[52] U.S. Cl. ..... 355/208; 355/259

[58] Field of Search ..... 355/208, 245, 355/259, 203, 204

[56] References Cited

U.S. PATENT DOCUMENTS

| | | | |
|---|---|---|---|
| 5,255,062 | 10/1993 | Oka et al. | 355/326 |
| 5,322,970 | 6/1994 | Behe et al. | 355/259 X |
| 5,359,399 | 10/1994 | Bares et al. | 355/259 |

*Primary Examiner*—R. L. Moses
*Attorney, Agent, or Firm*—Tallam I. Nguti

[57] ABSTRACT

In an electrophotographic reproduction machine including an image bearing member, latent image devices for forming on the image bearing member electrostatic latent images having a first polarity, and a hybrid development unit for applying to the latent images correct-sign toner particles having a second polarity relatively opposite to the first polarity, a method of automatically purging from the hybrid development unit wrong-sign toner particles having a third polarity relatively the same as the first polarity. The purging method includes the steps of counting and accumulating a number of image forming events performed by the reproduction machine for comparing to a stored predetermined number of such events, and of changing relative electrical bias values for a magnetic roll and for a donor roll within a housing of the development unit from imaging bias values to wrong-sign toner purging bias values so as to cause wrong-sign toner particles to transfer from the magnetic roll to the donor roll. The method also includes the steps of producing an electrostatic field on the image bearing member for causing wrong-sign toner particles to transfer from the donor roll to the image bearing member, and operating a cleaning device in contact with the image bearing member for removing wrong-sign toner particles from the image bearing member.

12 Claims, 3 Drawing Sheets

HYBRID DEVELOPMENT TYPE ELECTROSTATOGRAPHIC REPRODUCTION MACHINE HAVING A WRONG-SIGN TONER PURGING MODE

BACKGROUND OF THE INVENTION

This invention relates to electrostatographic reproduction machines, and more particularly to a hybrid development type electrostatographic reproduction machine having a wrong-sign or wrong-polarity toner purging mode.

Generally, the process of electrostatographic copying is executed by first using a corona generating or charging device to uniformly charge a photoreceptive member to a first polarity, and then exposing a light image of an original document, positioned in registration on a platen, onto the charged photoreceptive member. Exposing the charged photoreceptive member to a light image selectively discharges the photoconductive surface thereof in areas corresponding, for example, to non-image areas in the original document, while maintaining the charge (of the first polarity) on the image areas, thus creating an electrostatic latent image of the first polarity on the photoreceptive member. The undischarged areas comprising the electrostatic latent image are subsequently developed with correct-sign or correct-polarity charged toner particles into a visible toner image. The sign or polarity of such correct-sign or correct-polarity toner, as is well known, is relatively opposite the first polarity of the latent image being developed. Ordinarily, toner particles are contained in the sump of a development apparatus where they are moved and mixed with carrier particles in order to triboelectrically charge the toner to the correct polarity.

The toner image is thereafter transferred from the photoreceptive member onto a clean copy sheet on which the image is then fused or permanently affixed in order to provide a hard copy reproduction of the original document.

Unfortunately, the quality of the development step and that of the hard copy reproduction can be detrimentally affected by the effects of wrong-sign or wrong-polarity toner which forms and accumulates inside the sump of the development apparatus.

Wrong-sign toner in the development sump of an electrostatographic reproduction machine is ordinarily the source of many machine performance failure modes, some of which can have catastrophic effects.

Ordinarily, the generation of wrong-sign toner is not a major problem in electrostatographic reproduction machines using development systems that include a magnetic brush. This is because magnetic brush development systems each have a built-in method of purging themselves of wrong-sign toner. This built-in method involves the magnetic brush which has oppositely charged carrier particles on it that contact both image and background areas on the photoreceptor of the machine. During such contact, wrong-sign toner particles on the magnetic brush see each background area of the photoreceptor as a "development field" to which to transfer. This is because background areas are biased to repel correct-sign toner thus acting as a background cleaning field for toner of the correct sign or polarity. As such wrong-sign toner particles which have a polarity opposite to that of the correct-sign toner particles, obviously become attracted to these background areas, and so are transferred thus from and out of the developer housing.

On the other hand, in hybrid development systems, which have a donor roll and do not have a magnetic brush that contacts both the image and background areas of the photoreceptor, this built-in method has been removed, and there is therefore no built-in normal pathway for wrong-sign toner to be transferred from the development housing. Wrong-sign toner therefore tends to detrimentally accumulate in title development housing.

It is therefore an object of the present invention to provide a method to purge wrong-sign toner from Hybrid Development housings.

It is also an object of the present invention to purge wrong-sign toner according to a process that is transparent to a customer.

It is also an object of the present invention to selectively apply a cleaning field to the roll nip between a magnetic roll and a donor roll of a hybrid development system for cleaning the donor roll of right-sign toner while also attracting wrong-sign toner to it.

It is a further object of the present invention to selectively leave the wires, the SED electrodes, or jumping AC bias means in a hybrid development housing activated such that a wrong-sign toner cloud is created within the development zone.

It is still a further object of the present invention to selectively bias the donor roll and the photoreceptor so that the wrong-sign toner cloud in the development zone will be attracted to the photoreceptor for subsequent cleaning and removal by a cleaning apparatus.

SUMMARY OF THE INVENTION

According to one aspect of the present invention, there is provided in an electrophotographic reproduction machine including an image bearing member, latent image devices for forming on the image bearing member electrostatic latent images having a first polarity, and a hybrid development unit for applying to the latent images correct-sign toner particles having a second polarity relatively opposite to the first polarity, a method of automatically purging from the hybrid development unit wrong-sign toner particles having a third polarity relatively the same as the first polarity. The purging method includes the steps of counting and accumulating a number of image forming events performed by the reproduction machine for comparing to a stored predetermined number of such events, and of changing relative electrical bias values for a magnetic roll and for a donor roll within a housing of the development unit from imaging bias values to wrong-sign toner purging bias values so as to cause wrong-sign toner particles to transfer from the magnetic roll to the donor roll. The method also includes the steps of producing an electrostatic field on the image bearing member for causing wrong-sign toner particles to transfer from the donor roll to the image bearing member, and operating a cleaning device in contact with the image bearing member for removing wrong-sign toner particles from the image bearing member.

According to another aspect of the present invention, there is provided in an electrophotographic reproduction machine including an image bearing member, latent image devices for forming on the image bearing member electrostatic latent images having a first polarity, and a hybrid development unit for applying to the latent images correct-sign toner particles having a second polarity relatively opposite to the first polarity, purging apparatus for automatically purging from the hybrid development unit wrong-sign toner particles having a third polarity relatively the same as the first polarity. The purging apparatus includes first biasing means including a first bipolar DC power supply having first and second poles for biasing a magnetic roll mounted within a housing of the hybrid development unit, and second biasing means including a second bipolar DC power supply having first and second poles for biasing a donor roll mounted, and forming a toner transfer nip with the magnetic roll, within the housing of the hybrid development unit. The purging apparatus also includes a controller having an imaging mode and a purging mode. The controller is connected to the first and the second biasing means for selectively switching each of the first and said second DC power supplies between the first and second poles. Means are provided for producing an electrostatic field having a wrong-sign toner attracting polarity on the image bearing member, an a cleaning device is mounted against the image bearing member for removing wrong-sign toner particles from the image bearing member.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
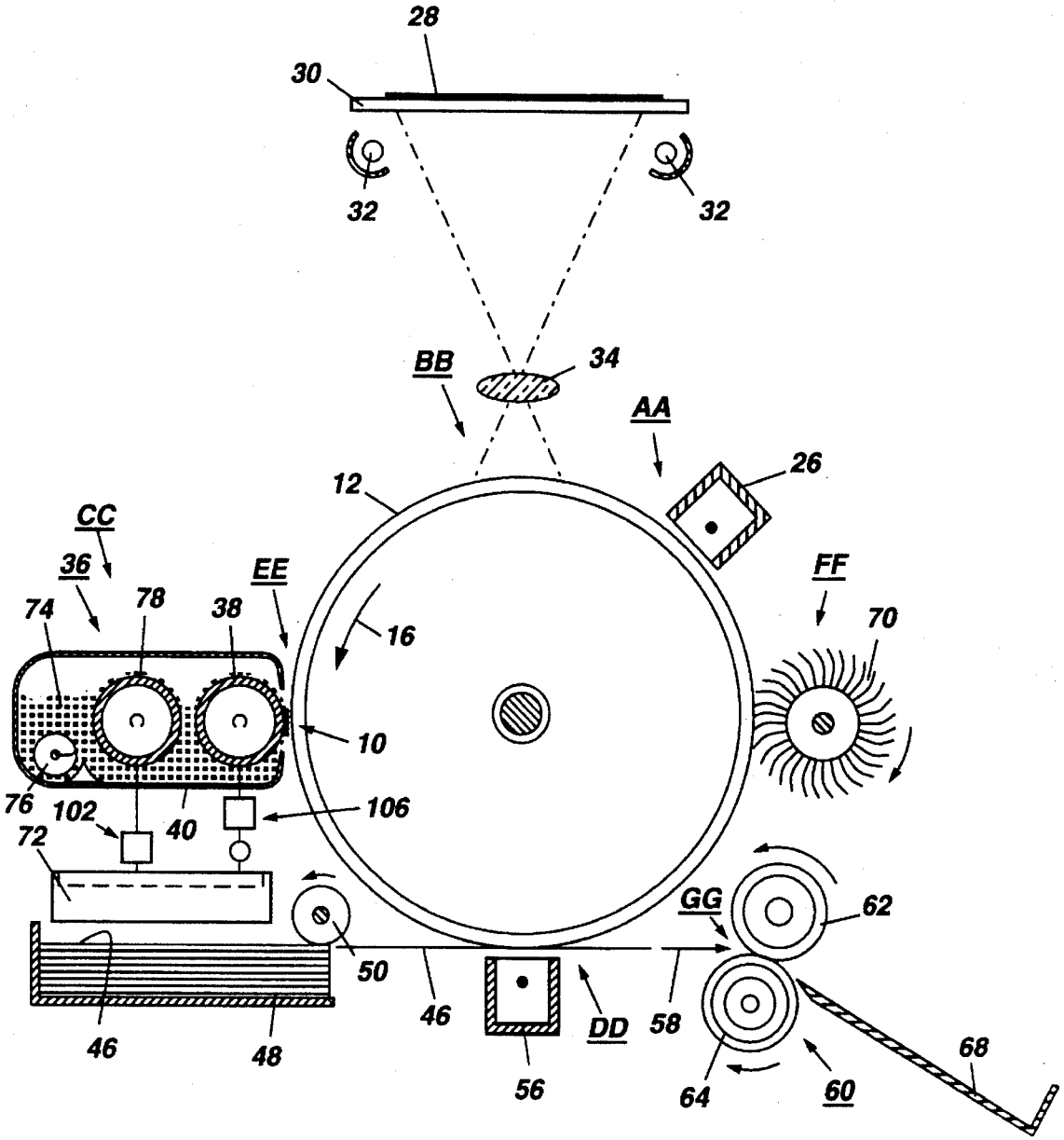
FIG. 1 is a schematic view showing an exemplary electrophotographic reproduction machine including a hybrid development system and the wrong sign toner purging apparatus of the present invention.

Referring initially to FIG. 1, an exemplary electrostatographic reproduction machine 8 incorporating a hybrid development apparatus and the automatic wrong-sign toner purging mode of the present invention is illustrated. The exemplary electrophotographic machine 8, for example, employs a photoreceptive member 10 shown as a drum 10 including a photoconductive surface 12. As is well known, the photoconductive member can equally be a suitably mounted belt having a photoconductive surface. The photoconductive drum 10 is coupled to a motor (not shown) for rotation about a process path in the direction of arrow 16 for advancing successive portions of photoconductive surface 12 through various processing stations disposed about the process path.

Initially, a surface portion of drum 10 passes through a charging station AA. At charging station AA, a corona generating device 26 for producing charges of a given first polarity charges photoconductive surface 12 to a relatively high and substantially uniform potential of the given first polarity.

Once charged, photoconductive surface 12 is advanced to an imaging station BB where an original document 28, positioned face down and in accordance with a fixed registration mark or position on a transparent platen 30, is exposed to light from light sources, such as lamps 32. Light rays from the lamps 32 are reflected imagewise from the document 28 thus forming a light image of the original document 28. The reflected rays are transmitted through a lens 34 and focused onto a portion of the charged photoconductive surface 12, selectively dissipating the uniform charge on impacted areas thereof. As such, an electrostatic latent image corresponding to the original document 28 is recorded onto photoconductive surface 12, for example, as the undischarged, first polarity areas of the portion of the surface 12. The discharged areas of the particular portion are therefore the background areas to this latent image.

Although an optical system has been shown and described for forming the light image used to selectively discharge the charged photoconductive surface 12, one skilled in the art will appreciate that a properly modulated scanning beam of energy (e.g., a laser beam) may equally be used to imagewise irradiate the charged portion of the photoconductive surface 12 in order to record the latent image thereon.

After the electrostatic latent image is recorded on photoconductive surface 12, drum 10 advances to development station CC where the hybrid development apparatus 36 of the present invention (to be described in detail below) transfers charged toner particles having a second polarity that is correctly opposite to the first polarity, onto the electrostatic latent image. Development apparatus 36, for example, may include a single developer roller 38 disposed in a developer housing 40. As shown, the hybrid development apparatus 36 includes a donor roller 38 that rotates, bringing the correct polarity charged toner particles into a development zone or nip formed with photoconductive surface 12, thus developing the latent image on the surface 12 into a visible toner image.

After development of the electrostatic latent image as such, drum 10 advances the toner image to transfer station DD. At transfer station DD, a sheet of support material 46 is moved into contact with the toner image by means of a sheet feeding apparatus 48. Preferably, sheet feeding apparatus 48 includes a feed roller 50 which rotates while in contact with a stack of sheets to advance the uppermost sheet. The advancing sheet of support material 46 is moved into contact with photoconductive surface 12 of drum 10 at transfer station DD in a timed sequence so that the developed image on the surface 12 contacts the advancing sheet of support material 46, and is transferred. A transfer corotron 56 is provided for projecting ions onto the backside of sheet 46 in order to aid in inducing the transfer of charged toner images from the photoconductive surface 12 onto support material 46.

The support material 46 is subsequently transported in the direction of arrow 58 for advancement to a fusing station EE. Fusing station EE includes a fuser assembly 60 for heating and permanently affixing the transferred toner image to sheet 46. Fuser assembly 60 preferably includes a heated fuser roller 62 and a support roller 64 forming a fusing nip for receiving and transporting a sheet of support material 46 therethrough. After fusing, the advancing sheet of support material 46 is moved to a receiving tray 68 for subsequent removal of the finished copy by an operator.

Invariably, after the support material 46 was separated from the photoconductive surface 12 of drum 10, some residual developing material remained adhered to drum 10. Thus, a final processing station, namely cleaning station FF, is provided for removing such residual toner particles from photoconductive surface 12 in preparation for subsequent charging and imaging on the surface 12 as described above. Cleaning station FF, for example, can include a rotatably mounted fibrous brush 70 for physical engagement with photoconductive surface 12 in order to remove toner particles therefrom.

The foregoing description is believed to be sufficient, for purposes of the present application for a patent, to illustrate the general operation of an electrostatographic reproduction or printer machine including the wrong-sign or polarity toner particles purging mode of the present invention.

Figure 2:
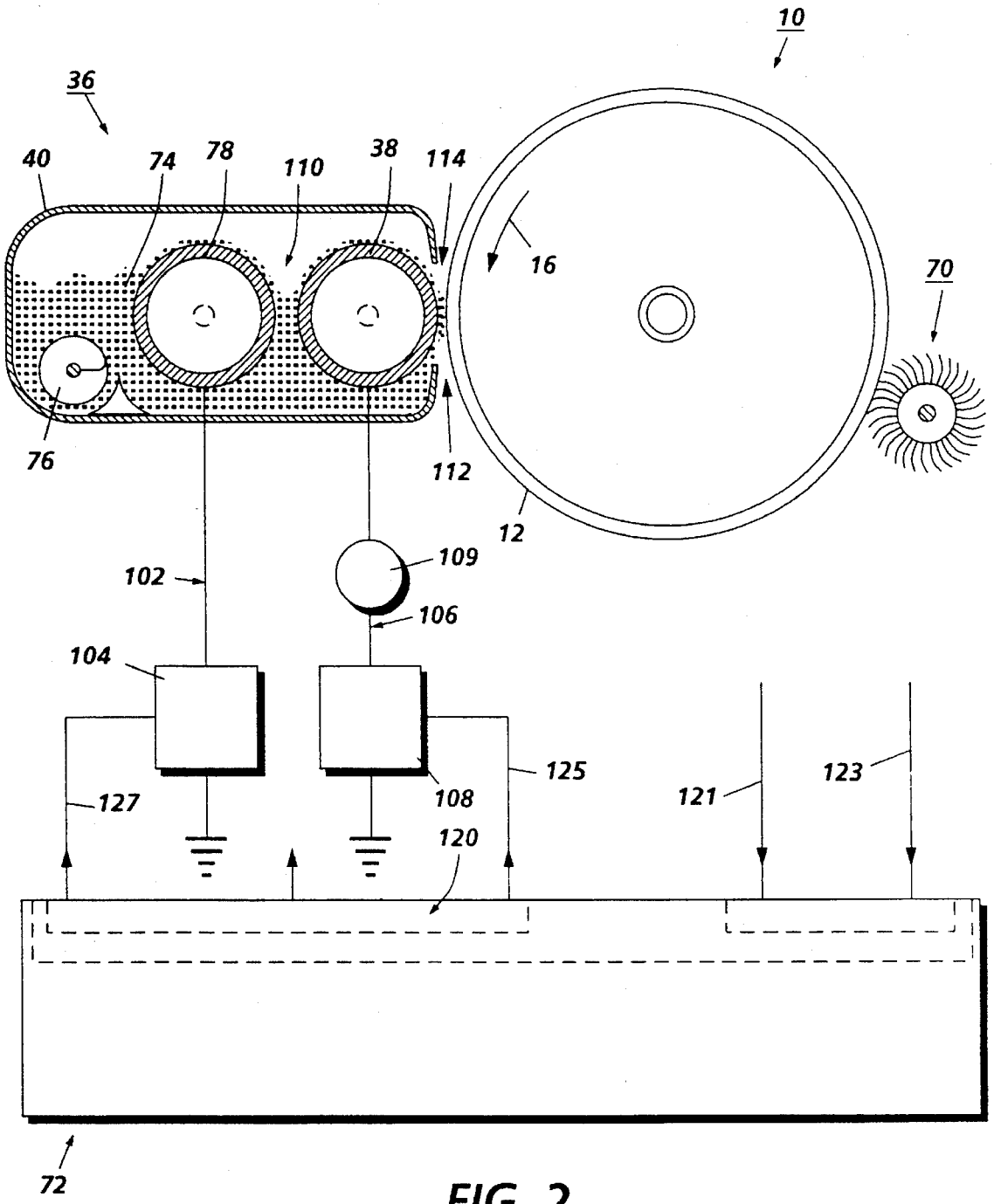
FIG. 2 is an enlarged detail of the biasing system and controller for the hybrid development system of FIG. 1.
Figure 3:
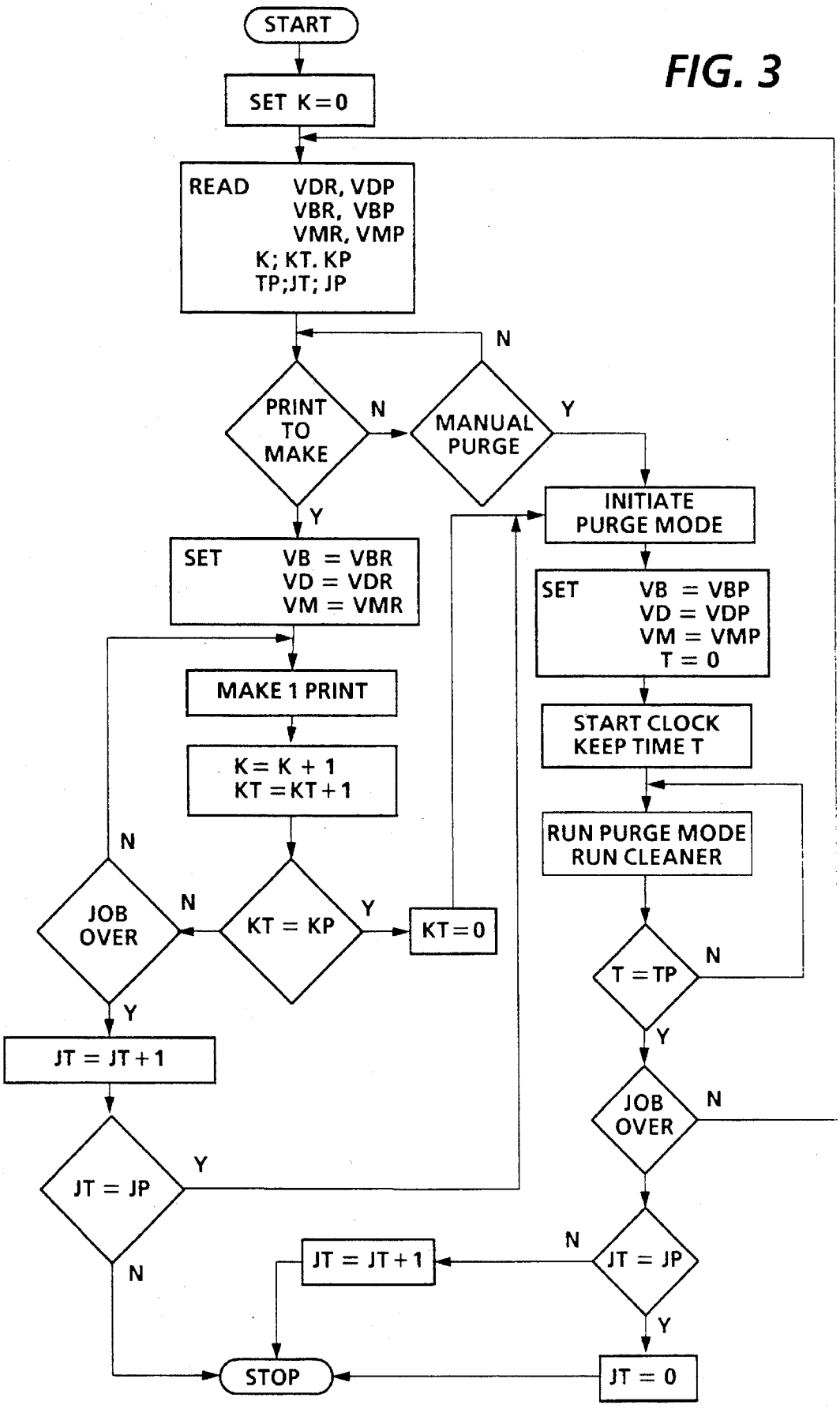
FIG. 3 is a flow process chart illustrating the wrong sign toner purging method of the present invention.

Referring now to FIGS. 2 and 3, a fragmentary portion of the machine 8 and an exemplary flow chart are shown illustrating purging apparatus, shown generally as 100, and a method for purging wrong-sign toner particles from the housing 40 of the hybrid development unit 36 according to the present invention.

The mechanism for producing wrong sign toner generally in a developer unit housing is ordinarily poorly understood. However, there are two likely possibilities. Both rely on a model in which the toner surface is broken into distinct patches, such as the surface of a soccer ball. The patches are distinguished by their tribo charging tendencies. The majority of the surface would likely have the tribo charging properties of the bulk toner resin, but areas that were rich in, say, pigment or internal additives would have different properties. Now, one has to imagine that in a toner sample of many particles there is a distribution of patch patterns, and that if this sample is mixed with carrier the time history of charging contacts for each toner will form another distribution. Within this model there are two ways to form wrong sign toner.

Some part of the original toner distribution will have large amounts of surface area that would have tribo charging properties that would tend to create wrong sign toner when mixed with the carrier. This is the "bad toner" hypothesis; removing this part of the toner distribution would leave only the toner that would charge to the correct polarity. The time distribution of contacts with carrier will have a small part that favors contact with the patches on toners that want to charge with the wrong polarity. This is the "statistical" hypothesis; wrong sign toners do not have any intrinsically bad physical property, they were just statistically unlucky in their history of contacts with carriers.

Note that any scheme for removing wrong sign toner from a developer sump will be much more effective if mechanism 1 is correct. However, even if mechanism 2 is correct, our tests have shown that the time required to build up significant amounts of wrong sign toner is long enough that a purging procedure would have benefit. And is is possible that both mechanisms contribute to the production of wrong sign toner.

The growth or creation of wrong-sign toner in a hybrid development system can also be explained in the alternative as follows. Hybrid development systems for example include systems such as wire Hybrid Scavengeless Development or (HSD);, embedded electrode HSD systems; and Hybrid Jumping Development (HJD) systems. The typical characteristic feature of each of these systems is an initial transfer of toner from a magnetic brush or roll to a donor roll within the sump of the development housing, followed by a subsequent transfer of the toner by the donor roll to a photoreceptor. The donor roll potential is usually different from that of the magnetic roll so as to establish a driving electric field such that toner of the correct sign or polarity is transferred to it from the magnetic roll.

After correct sign toner transfers to the donor roll as such, not all of it is transferred to the image areas of the photoreceptor. As a result, a layer of correct sign continues to build up on the ,donor roll until the electric potential at the surface of the donor roll roughly equals the magnetic roll potential. At that point, further toner transfer from the magnetic roll to the donor roll stops because the driving electric field has been reduced to zero. If a section of the donor roll thereafter transfers toner thereon to the photoreceptor, then during its next pass through its nip with the magnetic roll, there will be an electric field differential there to cause correct-sign toner to again transfer from the magnetic roll and replenish the donor roll in that particular section.

Unfortunately, however, at no time during a normal hybrid development process are there ordinarily opposite electric field differential conditions between the magnetic roll and donor roll, that are suitable to cause or encourage wrong-sign toner (i.e. non-correct sign toner) to transfer from the magnetic roll to the donor roll. As such, hybrid development systems more than magnetic brush systems, therefore, are likely to detrimentally accumulate excessive amounts of wrong-sign toner within the development housing and on the magnetic roll in the sump.

One problem with such detrimental accumulation is the occurrence of a relatively higher developed background on sheet prints or copies developed from a machine with such system. Even where some wrong-sign toner does leave the development housing and gets to the surface of the donor roll, this usually undesirable. This is because it does so most likely when the donor roll is saturated, and when the electric field in the nip between the magnetic roll and donor roll is close to zero which acts against the desired transfer of correct sign toner. In addition, once such wrong sign toner is on the donor roll, it tends undesirably to transfer to the background areas of an image on the photoreceptor.

Another problem with the accumulation of wrong-sign toner in a hybrid development housing is "snowplowing" which is associated particularly with wire-HSD systems. When "snowplowing" occurs, wrong-sign toner actually combines with correct-sign toner to form large, neutral toner agglomerates. Because such toner agglomerates are too massive to slide underneath the wires, as well as have too low a charge to be electrically pulled over the wires, these agglomerates tend to collect on and undesirably contaminate HSD wires.

Other problems with wrong-sign toner accumulation in a hybrid development housing include toner emissions and insufficient roll cleaning. Toner emissions occur because wrong-sign toner is relatively low charged and, hence, harder to control. On the other hand, insufficient roll cleaning occurs principally in multipass Image-on-Image hybrid development systems in which only one development housing per pass develops or transfers toner to the photoreceptor. During each such pass, the other development housings, of course, must be prevented from developing or transferring toner. This is achieved, for example, by cleaning the donor rolls of toner by turning off the toner cloud generator (wires or SED electrodes), and by biasing the donor rolls so as to provide a large cleaning or correct-toner repelling potential to all parts of the photoreceptor. Unfortunately, however, these methods tend to cause wrong-sign toner to be undesirably attracted during process or imaging cycles to the donor roll and then to the images on the photoreceptor thereby contaminating the images.

The method and apparatus of the present invention for purging wrong-sign toner are therefore particularly useful (as shown if FIG. 1) in an electrophotographic reproduction machine 8 that includes an image bearing member 10, latent image devices 26, 28–34 for forming on the image bearing member electrostatic latent images having a first polarity, and that includes a hybrid development unit 36 for applying to the latent images correct-sign toner particles having a second polarity relatively opposite to the first polarity.

Specifically, the method of the present invention is useful for manually or automatically purging from the hybrid development unit 36 wrong-sign toner particles having a third polarity relatively the same as the first polarity. The automatic purging method includes the steps of counting and accumulating a number of image forming events performed (e.g. "KT" prints made; and "JT" jobs run) by the reproduction machine 8 for comparing to a stored predetermined number (KP; JP) of such events. The method also includes the step of changing relative electrical bias values for a magnetic roll 78 and for a donor roll 38 within the housing 40 of the development unit from imaging bias values (VMR, VDR) to wrong-sign toner purging bias values (VMP, VDP) so as to cause wrong-sign toner particles to transfer from the magnetic roll 78 to the donor roll 38. The method further includes the steps of producing an electrostatic field on the image bearing member 10 for causing wrong-sign toner particles to transfer from the donor roll 38 to the image bearing member 10, and of operating a cleaning device 70 in contact with the image bearing member for removing wrong-sign toner particles from the image bearing member.

The step of changing relative electrical bias values for the magnetic roll 78 and for the donor roll 38 consists of changing the polarity and magnitude of imaging bias values (VMR, VDR FIG. 3) for the magnetic roll and for the donor roll respectively in order to obtain purging bias values (VMP, VDP) for such rolls, where "M" is for magnetic roll, and "D" is for donor roll. As shown in FIG. 2, the purging apparatus 100 includes first biasing means 102 including a first bipolar DC power supply 104 having first and second poles (+, –) for biasing the magnetic roll 78 that is mounted within the housing 40 of the hybrid development unit 36. A second biasing means 106 including a second bipolar DC power supply 108 also having first and second poles (+, –) is similarly provided for biasing the donor roll 38. The second biasing means 106 also includes an AC power source 109 connected to said second biasing means for applying an AC bias to the donor roll. As mounted within the housing 40 the donor roll forms a first toner transfer nip 110 with the magnetic roll 78, and a second toner transfer or development nip 112 with the image bearing member 10.

As is well known in the case of hybrid development units, AC biased electrodes such as wires 114, for example (since toner jumping can also be achieved only with DC biasing), are located within the development nip 112 for producing a toner cloud within the development nip 112. In the above scheme using a bipolar power supply, ground potential lies somewhere between the bias of the don or roll and that of the photoreceptor. However, a scheme can also be devised for a unipolar power supply where ground potential was less in magnitude than the bias of the magnetic roll. In the purging mode for purging positive wrong sign toner, the critical arrangement of the biases or potentials of the magnetic roll, donor roll and photoreceptor is for the donor roll to be more negative than the magnetic roll, and for the photoreceptor to be most negative. Ground potential then can fall anywhere in that range.

The purging apparatus 100 also includes a controller 120 that is part of the electronic control subsystem (ESS) 72 of the machine 8. The controller 120 importantly has two operating modes, an imaging mode (MR), and a purging mode (MP). As illustrated, the controller is connected to the first and the second biasing means 102, 106 respectively for selectively switching each of the first and the second DC power supplies 104, 108 respectively between the first and second poles thereof. The controller 120 includes programmed means (FIG. 3) for automatically controlling switching of the DC power supplies between the first and second poles (+, –) on a basis of a predetermined number (JP) of reproductions jobs run by the machine. In addition, the controller 120 includes programmed means (FIG. 3) for automatically controlling switching of the DC power supplies between the first and second poles (+, –) on a basis of a predetermined cumulative total number (KP) of reproductions made by the machine.

Still referring to FIG. 2, the controller 120 for the hybrid scavengeless development unit 36 includes a counter and input channels for receiving, for example, a copy count signal 121, and a charge corotron status signal 123. The copy count signal 121 can be for every latent image that is developed, which usually is the same as the number of copies or prints made by the reproduction machine 8. The charge corotron status signal 123 indicates whether the charge corotron 26 is active or not charging the image bearing member 10.

Outputs from the controller 120 include a voltage level output control signal 125 for the donor roll voltage or bias, and a voltage level output control signal 127 for the magnetic roll voltage or bias. The controller outputs also include a control signal (not shown) for controlling the drive motor for the entire hybrid scavengeless development unit 36. The magnetic roll voltage output control signal 127 is connected to the bipolar DC power supply 104 for the magnetic roll 78, and the donor roll voltage output control signal is connected to the bipolar DC, and AC power supplies 108 109 respectively for the donor roll 38. As such, the voltage level, and hence appropriate bias for the magnetic roll 78 as well as for the donor roll 38 can be achieved selectively, and at desired predetermined values for the purposes of the present invention.

The purging apparatus 100 further includes means for producing an appropriate electrostatic field on the image bearing member that has a wrong-sign toner attracting polarity. Such means in one case can comprise a corona device such as 26 for applying charges of an appropriate polarity onto the member 10, and in another case, it can comprise an erase lamp for erasing any charges on the member 10. Preferably, such a field is produced on at least an entire image frame at a time, thereby allowing for the method of the present invention to be carried out on a skipped image frame or frames during and imaging cycle.

Finally, the purging apparatus 100 includes a cleaning device 70 that is mounted against the image bearing member 10 and downstream of the development nip 112 for removing from the image bearing member 10 the wrong-sign toner particles purged from the development unit 36.

Accordingly, this purging procedure could be carried out routinely during the cycle up or cycle down sequences of the machine 10. If, because of long job runs, this time is insufficient to keep the creation and concentration of wrong-sign toner within the development housing 40 at an acceptable level, the purging procedure preferably should be occasionally implemented in process during the passage of a skipped pitches or image frame on the photoreceptor. If the number or percentage of occasional skipped pitches or frames is kept low, the loss in productivity will be minimal, and the customer is unlikely to notice such a slight loss.

This purging procedure, for example, was implemented and tested in an electrostatographic reproduction machine using wire HSD system. The results showed that the amount of wrong-sign toner in the development housing sump, as measured by a charge spectra, was significantly decreased with this procedure. In addition, the effectiveness of implementing this procedure while occasionally skipping one or two image frames every 100 prints, for example, was demonstrated.

Referring again to FIGS. 1 and 2, the machine control system 72 and the development unit controller 120 were set initially to the imaging mode in which the magnetic brush imaging voltage VMR on the bipolar DC power supply 104 was set at −150 volts, that of the donor roll VDR on power supply 108 was set at −50 volts. The donor roll AC voltage preferably is a square wave at about 2.5 kHz and was controlled at 300 volts peak to peak. The corona or scorotron device 26 was controlled to charge the photoreceptor 10 to an imaging voltage VBR of −500 volts, and since this was a discharged area development process (DAD process), the optical imagewise exposure system devices 28–34 were set to discharge image areas of the charged photoreceptor 10 to a voltage of −50 volts. Developer, consisting of carrier particles and negatively charged (i.e. to a voltage level less than −50 volts) correct sign toner particle solids, was used as described above to develop formed discharged area latent images. Accordingly, wrong sign toner particles generated within the development housing 40 would be positively charged particles.

Referring to FIG. 3, when the machine 8 is started up, usually to run a job using parameters as set above, the controller 120 sets k, the number of prints or copies for the job to zero. It reads VMR, VDR, VBR, as above. It also reads VMP, VDP, VBP the purging bias or voltage values for the magnetic roll, donor roll and photoreceptor respectively. These purging bias values can be different depending on the relative polarity of the electrostatic field created on at least an entire image frame portion of the photoreceptor 10 by charging or discharging such entire image frame. The controller then reads KT (the cumulative total number of copies over a series of jobs), KP and JP as discussed above, and JT (the cumulative total number of jobs over a period of time).

The machine 8 then makes prints as discussed above, and in a manner according the process of FIG. 3, until a KP or JP event check is met for automatically initiating or switching to the purging mode. As shown, it can also manually be placed into the purging mode In the purging mode, for purging positive, wrong sign toner particles from the development housing 40, more specifically from the surface of the magnetic roll 78, the bias or voltage of the magnetic roll 78 is switched from −150 volts to +350 volts, and that of the donor roll 38 is switched from −50 volts to +200 volts, leaving a voltage differential of −150 volts (i, e, 200–350 volts) for causing positive wrong sign toner to transfer from the magnetic roll to the donor roll. With the above magnetic roll and donor roll settings, the appropriate electrostatic field on the photoreceptor 10 is an undischarged image frame at −500 volts. Such a frame or frames can be generated as discussed above by controllably skipping them during an imaging cycle, without a perceptible productivity loss to a user.

Alternatively, in the purging mode, the bias or voltage of the magnetic roll 78 can also be switched from −150 volts to +850 volts, and that of the donor roll 38 is then switched from −50 volts to +700 volts, leaving a voltage differential of −150 volts (i, e, 700–850 volts) for causing positive wrong sign toner to transfer from the magnetic roll to the donor roll. With these alternative magnetic roll and donor roll settings, the appropriate electrostatic field on the photoreceptor 10 is instead a fully discharged image frame or frames at 0 volts, instead of the initial −500 volts.

In the purging mode set up according to either of the above alternatives, correct sign toner (i.e. negative toner) on the donor roll 38 will be caused by the +350 volts or +850 volts bias on the magnetic roll 78 to transfer backwardly (and oppositely relative to imaging mode transfer) from the donor roll 38 to the magnetic roll 78. At the same time, wrong sign toner (i.e. positive toner) on the magnetic roll 78 at +350 volts or +850 volts, will be caused by the −150 volt difference to transfer to the donor roll 38. In addition, there is a strong −700 volt field difference within the development nip 112 (i.e. 0 volts −700 volts, or −500 volts −200 volts) for causing the positive, wrong sign toner particles now on the donor roll to transfer onto the electrostatic field (i.e. all charged or all discharged) image frame or frames of the photoreceptor 10. The AC electrodes, wires within the nip 112 preferably are also activated to generate a toner cloud of the wrong sign toner in order to enhance the transfer of such toner to the photoreceptor 10. The cleaning device 70 is normally run to then remove the wrong sign toner from the photoreceptor 10.

The purging mode and cycle as such can be set to run automatically, for example, at KT equal to 14k prints or at every 100 prints with a duration of TP equal to 3 seconds for example. Although the experiment was done with a wires HSD development system, however it should work equally well for SED, hybrid jumping (HJD) or any hybrid development system using a donor roll and a magnetic brush roll.

It is, therefore, apparent that there has been provided in accordance with the present invention, a method and apparatus for effectively and automatically purging wrong sign toner from the development housing of a hybrid development unit of an electrophotographic reproduction machine that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. In an electrophotographic reproduction machine including an image bearing member, latent image devices for forming on the image bearing member electrostatic latent images having a first polarity, and a hybrid development unit for applying to the latent images correct-sign toner particles having a second polarity relatively opposite to the first polarity, purging apparatus for automatically purging from the hybrid development unit wrong-sign toner particles having a third polarity relatively the same as the first polarity, the purging apparatus comprising:

(a) first biasing means including a first bipolar DC power supply having first and second poles for biasing a magnetic roll mounted within a housing of the hybrid development unit;

(b) second biasing means including a second bipolar DC power supply having first and second poles for biasing a donor roll mounted, and forming a toner transfer nip with the magnetic roll, within the housing of the hybrid development unit;

(c) a controller having an imaging mode and a purging mode, said controller being connected to said first and said second biasing means for selectively switching each of said first and said second DC power supplies between said first and second poles;

(d) means for producing an electrostatic field having a wrong-sign toner attracting polarity on the image bearing member; and (e) a cleaning device mounted against said image bearing member for removing wrong-sign toner particles from the image bearing member.

2. The purging apparatus of claim 1, including AC biased electrodes located within a development nip formed by the donor roll and said image bearing member for producing a toner cloud of wrong-sign toner with the development nip.

3. The purging apparatus of claim 1, including an AC power source connected to said second biasing means for applying an AC bias to the donor roll.

4. The purging apparatus of claim 1, wherein said controller includes programmed means for automatically controlling switching of said power supplies on a basis of a predetermined number of reproductions jobs run by the machine.

5. The purging apparatus of claim 1, wherein said controller includes programmed means for controlling switching of said power supplies on a basis of a predetermined cumulative total of reproductions made by the machine.

6. The purging apparatus of claim 1, wherein said means for producing on the image bearing member an electrostatic field having a polarity for attracting wrong-sign toner comprises a charge erasing light source for erasing charge from the image bearing member.

7. The purging apparatus of claim 1, wherein said means for producing on the image bearing member an electrostatic field having a polarity for attracting wrong-sign toner comprises a corona device for applying a layer of charge on the image bearing member.

8. In an electrophotographic reproduction machine including an image bearing member, latent image devices for forming on the image bearing member electrostatic latent images having a first polarity, and a hybrid development unit for applying to the latent images correct-sign toner particles having a second polarity relatively opposite to the first polarity, a method of automatically purging from the hybrid development unit wrong-sign toner particles having a third polarity relatively the same as the first polarity, the purging method comprising the steps of:

(a) counting and accumulating a number of image forming events performed by the reproduction machine for comparing to a stored predetermined number of such events;

(b) changing relative electrical bias values for a magnetic roll and for a donor roll within a housing of the development unit from imaging bias values to wrong-sign toner purging bias values so as to cause wrong-sign toner particles to transfer from the magnetic roll to the donor roll;

(c) producing an electrostatic field on the image bearing member for causing wrong-sign toner particles to transfer from the donor roll to the image bearing member; and (d) operating a cleaning device in contact with the image bearing member for removing wrong-sign toner particles from the image bearing member.

9. The method of claim 8, wherein said step of changing relative electrical bias values for the magnetic roll and for the donor roll comprises changing the polarity and magnitude of imaging bias values for the magnetic roll and for the donor roll to purging bias values for such rolls.

10. The method of claim 9, wherein said electrostatic field producing step comprises producing on at least an entire imaging frame of the image bearing member, a uniform electrostatic field having a polarity relatively the same as the first polarity of latent images formed on the image bearing by the latent image devices.

11. The method of claim 9, wherein said electrostatic field producing step comprises producing on at least an entire imaging frame of the imaging member, a uniform electrostatic field having a polarity relatively opposite the first polarity of latent images formed by the latent image devices.

12. In an electrophotographic reproduction machine including an image bearing member, latent image devices for forming on the image bearing member electrostatic latent images having a first polarity, and a hybrid development unit for applying to the latent images correct-sign toner particles having a second polarity relatively opposite to the first polarity, purging apparatus for automatically purging from the hybrid development unit wrong-sign toner particles having a third polarity relatively the same as the first polarity, the purging apparatus comprising:

(a) first biasing means including a first DC power supply for biasing a magnetic roll mounted within a housing of the hybrid development unit;

(b) second biasing means including a second DC power supply for biasing a donor roll mounted, and forming a toner transfer nip with the magnetic roll, within the housing of the hybrid development unit;

(c) a controller having an imaging mode and a purging mode, said controller being connected to said first and said second biasing means for selectively changing biasing values of each of said first and said second DC power supplies so as to control charged toner flow;

(d) means for producing an electrostatic field having a wrong-sign toner attracting polarity on the image bearing member; and (e) a cleaning device mounted against said image bearing member for removing wrong-sign toner particles from the image bearing member.

* * * * *